US008963793B2

(12) United States Patent
Saliga et al.

(10) Patent No.: US 8,963,793 B2
(45) Date of Patent: Feb. 24, 2015

(54) DUAL BAND ANTENNA DESIGN

(75) Inventors: Stephen V. Saliga, Akron, OH (US); Thomas Lutman, Cuyahoga Falls, OH (US)

(73) Assignee: Cisco Technology, Inc., San Jose, CA (US)

( * ) Notice: Subject to any disclaimer, the term of this patent is extended or adjusted under 35 U.S.C. 154(b) by 419 days.

(21) Appl. No.: 12/837,156

(22) Filed: Jul. 15, 2010

(65) Prior Publication Data

US 2012/0013521 A1 Jan. 19, 2012

(51) Int. Cl.

| | |
|---|---|
| ***H01Q 1/50*** | (2006.01) |
| ***H01Q 9/04*** | (2006.01) |
| ***H01Q 5/00*** | (2006.01) |

(52) U.S. Cl.

CPC ..... *H01Q 9/0407* (2013.01); *H01Q 5/0093* (2013.01); *H01Q 9/045* (2013.01)

USPC ..... 343/860; 343/700 MS; 343/725; 343/789; 343/893

(58) Field of Classification Search

USPC ..... 343/700 MS, 860, 725, 772, 789, 893

See application file for complete search history.

(56) References Cited

U.S. PATENT DOCUMENTS

| | | | | |
|---|---|---|---|---|
| 6,812,902 | B2 * | 11/2004 | Rossman et al. | 343/725 |
| 7,692,601 | B2 * | 4/2010 | Bisiules et al. | 343/803 |
| 2003/0210193 | A1 * | 11/2003 | Rossman et al. | 343/725 |
| 2004/0021606 | A1 * | 2/2004 | Shigihara | 343/700 MS |
| 2009/0102723 | A1 * | 4/2009 | Mateychuk et al. | 343/700 MS |
| 2009/0128442 | A1 * | 5/2009 | Fujita et al. | 343/860 |

* cited by examiner

*Primary Examiner* — Dieu H. Duong
*Assistant Examiner* — Jae Kim
(74) *Attorney, Agent, or Firm* — Tucker Ellis LLP

(57) ABSTRACT

Disclosed in an example embodiment herein is a dual mode patch antenna designed to operate in the TM02 mode. The antenna comprising a circular patch antenna configured to operate at a first frequency, and a cylindrical matching element coupled to the circular patch antenna configured to operate at a second frequency. A feed surface is coupled to the cylindrical matching element.

20 Claims, 5 Drawing Sheets

DUAL BAND ANTENNA DESIGN

TECHNICAL FIELD

The present disclosure relates generally to antennas for wireless devices.

BACKGROUND

Many WiFi access points (APs) have traditionally used single band antennas due to the radio architectures used. For example, an AP operating in both the 2.4 GHz and 5 GHz bands would have separate antennas for each band in order to maintain some band-to-band isolation. For example, a multiple input multiple-output (MIMO) access point with 3 radio frequency (RF) paths would employ six antennas. A MIMO access point with 4 RF paths would employ eight antennas. However, for access points employing duplexers to maintain the proper band-to-band isolation, dual band antennas can be useful. Good designs delivering efficient omnidirectional coverage are desirable.

BRIEF DESCRIPTION OF THE DRAWINGS

The accompanying drawings incorporated herein and forming a part of the specification illustrate the examples embodiments.

OVERVIEW OF EXAMPLE EMBODIMENTS

Figure 1:
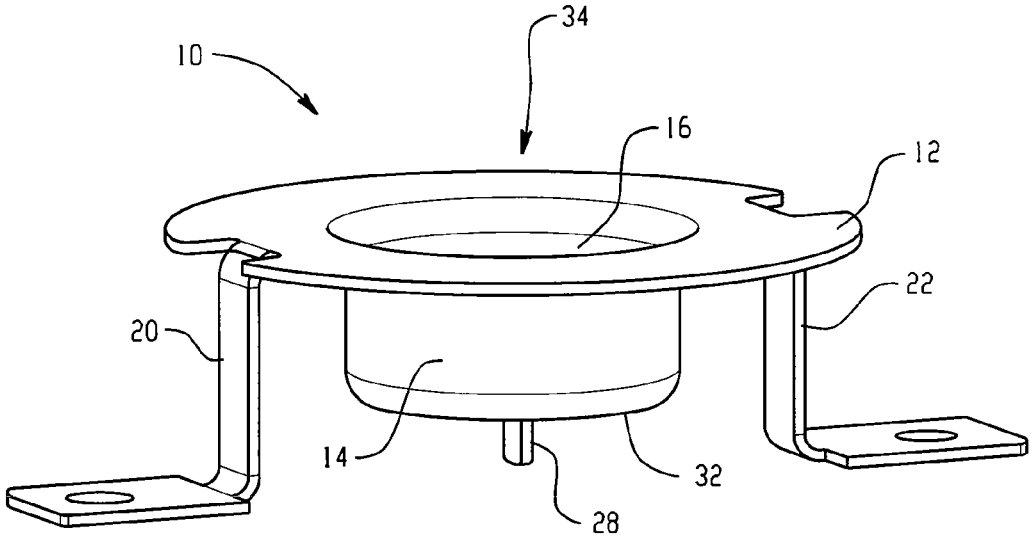
FIG. 1 is a perspective view of a dual band antenna.
Figure 2:
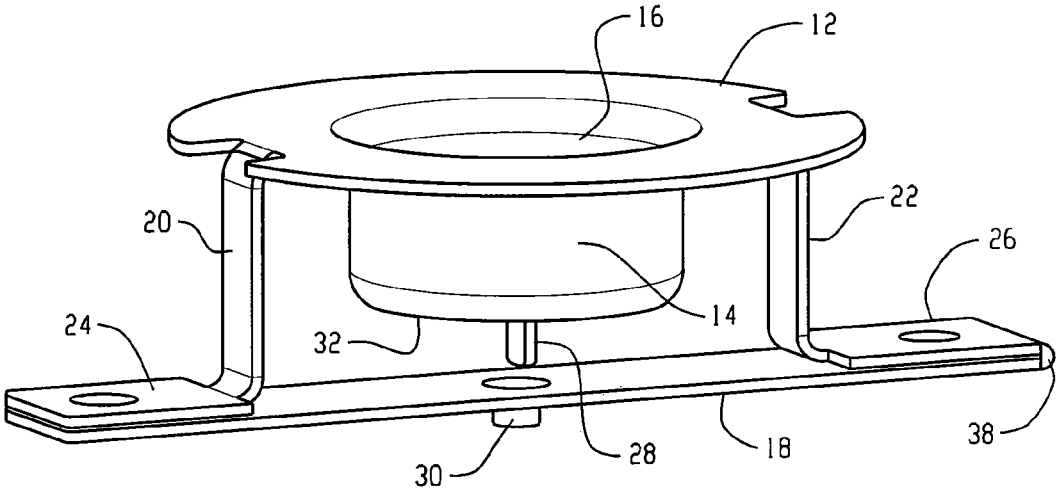
FIG. 2 is a perspective view of a dual band antenna with a grounding plane formed from a single piece of metal.
Figure 3:
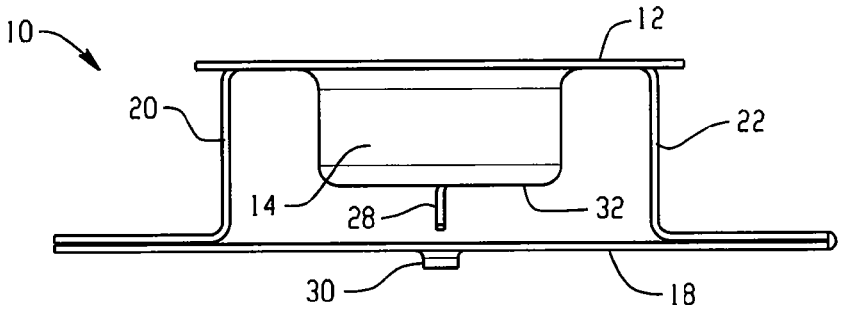
FIG. 3 is a side view of the dual band antenna of FIG. 2.
Figure 4:
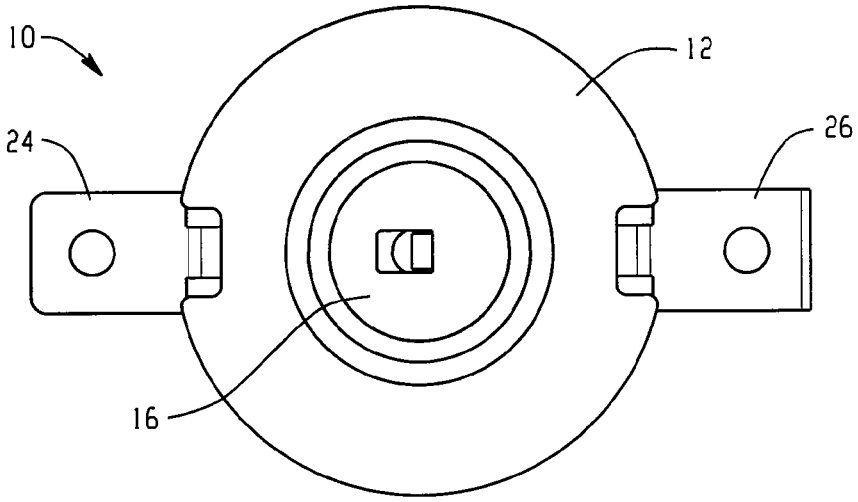
FIG. 4 is a top view of the dual band antenna of FIG. 2.
Figure 5:
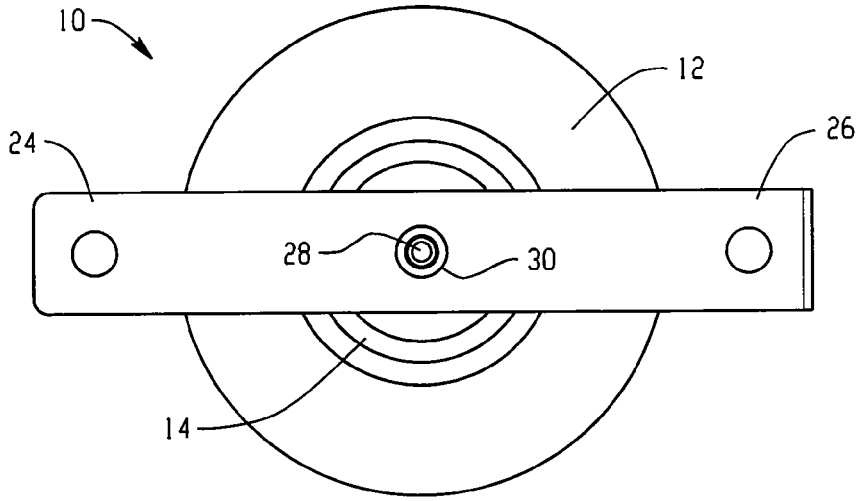
FIG. 5 is a bottom view of the dual band antenna of FIG. 2.

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein, an apparatus, comprising a circular patch antenna and a cylindrical matching element coupled to the circular patch antenna configured to provide a desired impedance at a predetermined frequency. A feed surface is coupled to the cylindrical element.

In accordance with an example embodiment, there is disclosed herein, a method comprising forming a circular patch antenna from a piece of metal. A cylindrical matching element is formed below the patch antenna. A feed surface is formed at the bottom of the cylindrical matching element.

DESCRIPTION OF EXAMPLE EMBODIMENTS

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

Described in an example embodiment herein is a dual band antenna that comprises a circular patch antenna operating in a TMO2 mode. Shorting pins and a cylindrical matching element are included to provide the appropriate impedance for the desired bands, for example the 2.4 GHz and 5 GHz bands. In particular embodiments, the antenna is formed with one piece of metal and includes a feed tab and a solder cup for use with thin coaxial cables.

Referring to FIG. 1, there is illustrated an example of a dual band antenna 10. Antenna 10 comprises a circular patch mode antenna 12 and a cylindrical matching element 14. Circular patch mode antenna 12 can be tuned (e.g. the appropriate size, such as diameter is selected for a first desired band) to a first operating band. The depth, e.g., the distance between circular patch mode antenna 12 and bottom surface 32, and/or diameter of cylindrical matching element 14 can be selected to provide the appropriate impedance at a second desired band. A feed surface, such as a pin, 28 is coupled to cylindrical matching element 14.

Figure 7:
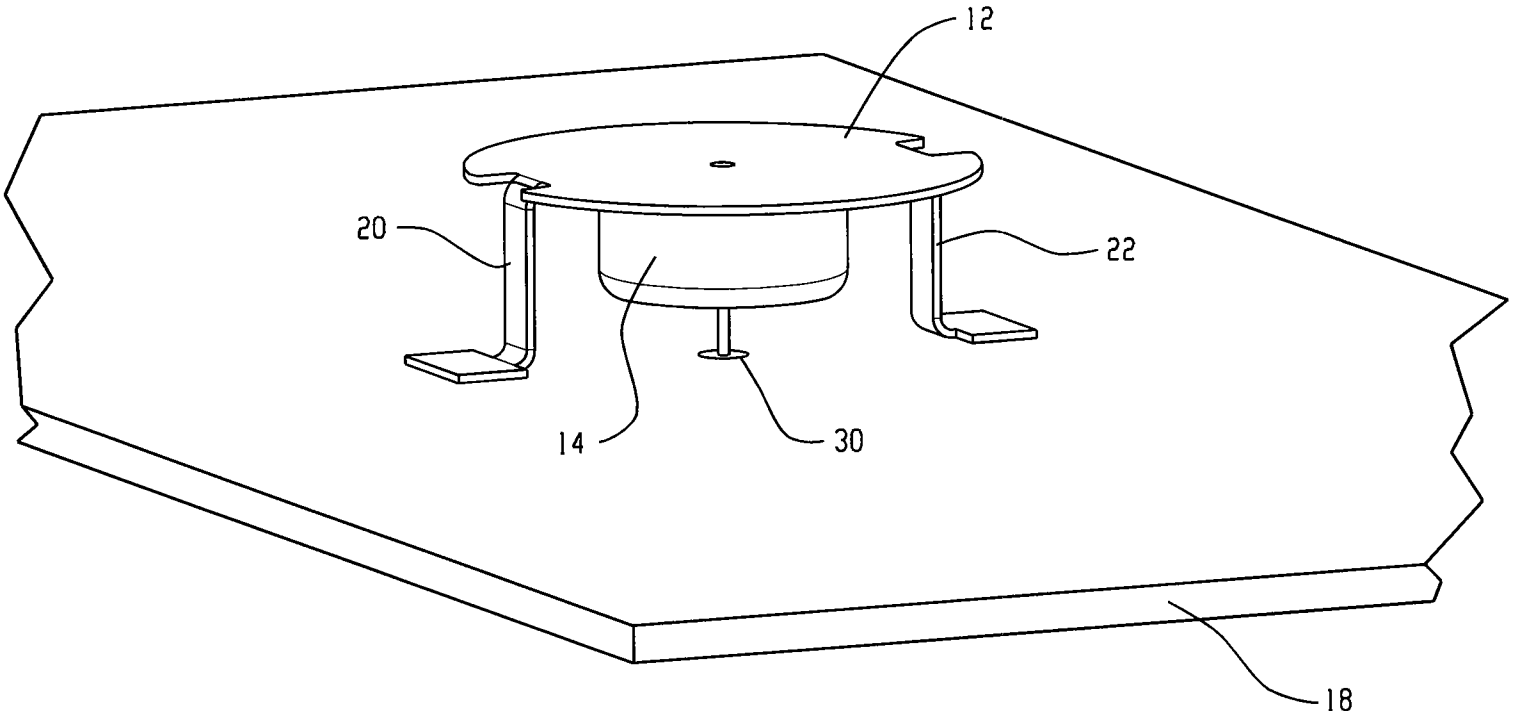
FIG. 7 illustrates a perspective view of a dual band antenna of FIG. 1 mounted to an external ground plane.

In particular embodiments, as will be described in more detail herein, there is an aperture 16 on the surface of circular patch mode antenna 12 corresponding to the diameter of cylindrical matching element 14. In an example embodiment this aperture 16 is aligned with the cylindrical matching element 14. Antenna 10 further comprises shorting strips 20, 22 coupled to tabs 24, 26 which can be employed to couple antenna 10 to a ground plane (see for example FIG. 7).

Referring now to FIGS. 2-5 with continued reference to FIG. 1, ground plane 18 is coupled to circular patch mode antenna 12 by shorting strips 20, 22. In an example embodiment, tabs 24, 26 are employed to couple strips 20, 22 to ground plane 18. A feed surface 28 is located on a bottom surface 32 of cylindrical matching element 14. Solder cup 30 is formed on grounding plane 18 and can be aligned with feed surface 28.

In an example embodiment, shorting pins 20, 22 are employed to load circular patch antenna 12. As those skilled in the art can readily appreciate, loading can be employed as a means to broadband an antenna, shrink the size of an antenna, control polarization, or otherwise influence the mode of operation. In an example embodiment, thin metal cylinders can be employed for shorting pins 20, 22. In another example embodiment, as will be described herein infra, shorting pins may be formed from a single piece of metal used to form circular patch antenna 12 and ground plane 18. In the illustrated example, two shorting pins 20, 22 are employed. In particular embodiments, shorting pins 20, 22 are symmetrical about the center 34 of circular patch antenna 12.

For example, without shorting pins, a TMO2 patch antenna for the 2.4 GHz band would be about 75 millimeters (mm) in diameter. With shorting pins 20, 22, the size of a TMO2 patch antenna for the 2.4 GHz band can be reduced to about 29 mm and located about 10 mm above ground plane 18. The width of shorting pins 20, 22 can be selected to duplicate the performance that would be provided by cylindrical shorting pins.

A cylindrical matching element 14 is designed to provide the proper impedance over a second band. For example, for an antenna operating in the 2.4 GHz and 5 GHz bands, cylindrical matching element 14 is designed to provide the proper impedance, for example 50 ohms. In an example embodiment, cylindrical matching element 14 is coupled to cylindrical patch antenna 12 and feed surface 28. In an example embodiment, the diameter and the depth (or length) of cylindrical matching element, which is the distance from circular patch antenna 12 and bottom surface 32 is selected to provide the appropriate impedance at the second band.

Figure 6:
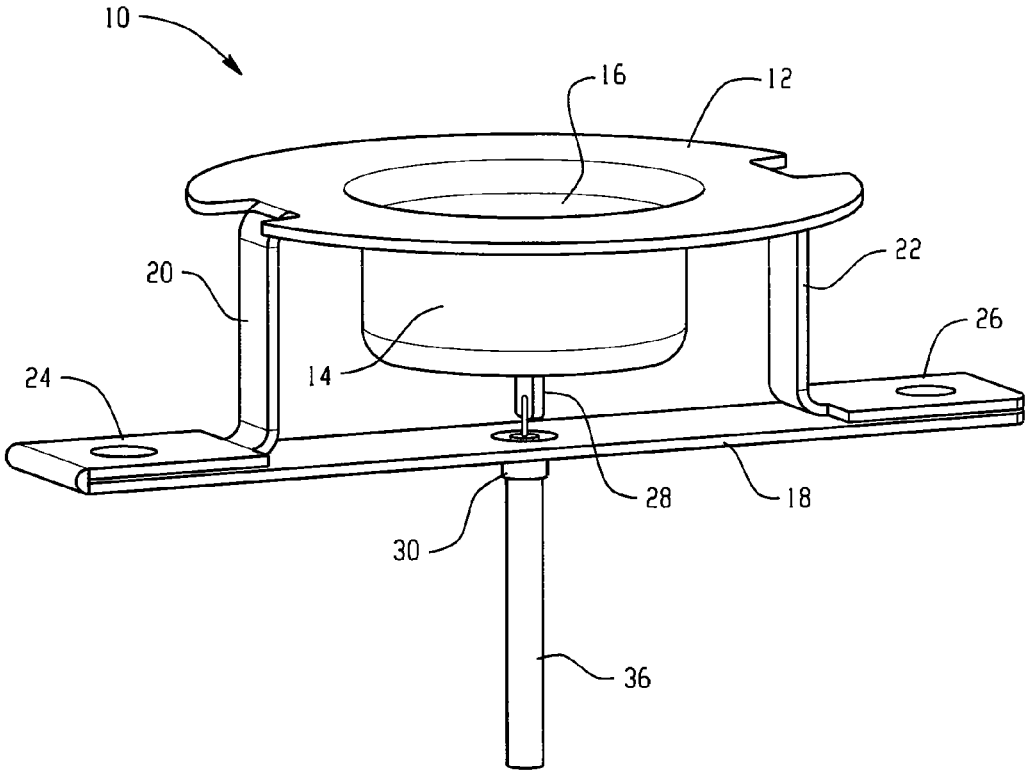
FIG. 6 is a perspective view illustrating the dual band antenna of FIG. 2 coupled to a coaxial cable.

In an example embodiment, because cylindrical matching element 14 is coupled to circular patch antenna 12, there are no fields below circular patch antenna 12 inside of cylindrical matching element 14. Therefore, the portion of circular patch antenna 12 that is inside of cylindrical matching element 14 may be removed, forming aperture 16. This enables a single piece of metal to be used to form circular patch antenna 12, cylindrical matching element 14, and shorting pins 20, 22. Shorting pins 20, 22 may be realized by bending metal flaps along the annular surface of circular patch antenna 12. Shorting pins 20, 22 may be attached to a ground plane, for example on a surface of an access point, which is illustrated in FIG. 6. In particular embodiments, one of the flaps may be longer than the other (for example the flap forming strip 22 in FIG. 1 is longer than the flap forming strip 20). The longer flap can have additional bends, including a 180 degree bend 38 to form ground strip or ground plane 18 illustrated in FIG. 1. This ensures that the entire antenna can be built from a single metal piece rather than a combination of two or more pieces.

FIG. 6 illustrates an example of a coaxial cable 36 coupled to antenna 10. The cable is passed through solder cup 30. The outer conductor of the coaxial cable (not shown) can be coupled to ground strip or plane 18 while the inner conductor (not shown) of the coaxial cable can be provided to feed surface 28.

Figure 8:
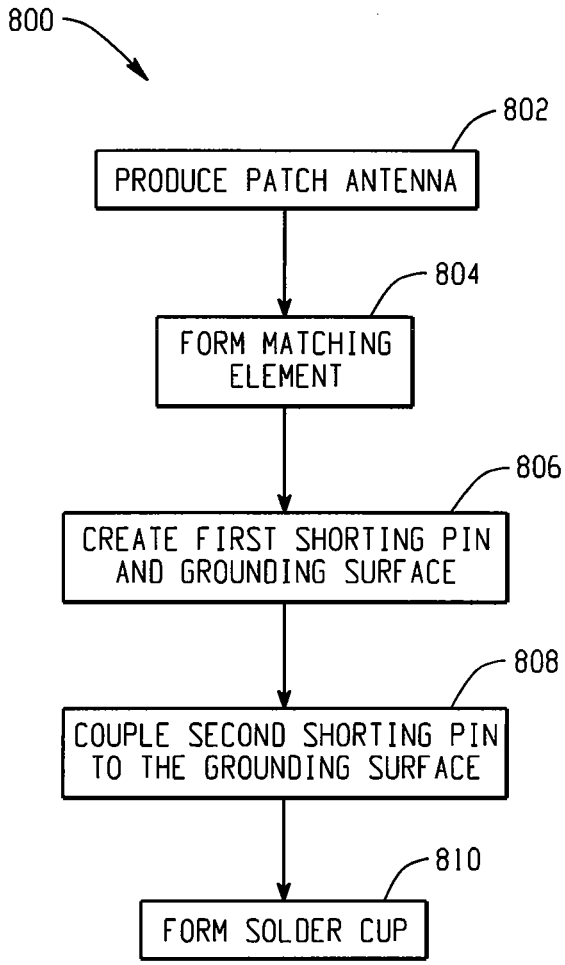
FIG. 8 illustrates an example methodology for forming a dual band antenna from a single piece of metal.

In view of the foregoing structural and functional features described above, a methodology 800 in accordance with an example embodiment will be better appreciated with reference to FIG. 8. While, for purposes of simplicity of explanation, methodology 800 is shown and described as executing serially, it is to be understood and appreciated that the example embodiment is not limited by the illustrated order, as some aspects could occur in different orders and/or concurrently with other aspects from that shown and described herein. Moreover, not all illustrated features may be required to implement methodology 800 in accordance with an aspect of an example embodiment.

At 802, a circular patch antenna is formed. The diameter of the circular patch antenna is selected to operate at a first predetermined band.

At 804, a cylindrical matching element is formed. In an example embodiment, the cylindrical matching element is formed below the circular patch antenna. In an example embodiment, a feed surface, such as a pin is formed on the bottom surface of the cylindrical matching element. The cylindrical matching element may be designed in a 'cup' shape where the circular patch antenna is at the top of the cup and a feed surface such as a pin is located at the bottom (or opposite) surface. The depth (the distance from the circular patch antenna to opposite side of the cylindrical matching element) and diameter of the cylindrical matching element may be selected to provide the appropriate impedance for a second predetermined band.

At 806, a tab coupled to the circular patch antenna is bent to form a first shorting pin. Additional bends are employed to provide a ground strip or ground plane. In particular embodiments, a 180 degree bend is employed so that the ground plane passes underneath the cylindrical matching element.

At 808, a second tab coupled to the circular patch antenna is bent to form a second shorting pin. The second shorting pin is coupled to the ground plane. The widths of the first and second shorting pins can be selected to provide the performance that would be realized by employing cylindrical shorting pins. The first and second shorting pins may be coupled to the ground plane using any appropriate means, such as screws, rivets, solder, etc.

At 810, a solder cup is formed on the ground plane. In an example embodiment, the solder cup is aligned with the feed surface located on the cylindrical matching element. In particular embodiments, the solder cup, and feed surface are aligned with the center of the circular patch antenna.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

The invention claimed is:

1. An apparatus, comprising:

a metal circular patch antenna tuned for a first band defining an aperture;

a hollow cup-shaped cylindrical matching element having a top end, a cylindrical middle portion, and a bottom end, formed below the circular patch antenna in a first direction, the cylindrical middle portion having a diameter, wherein the circular patch antenna is coupled with the top end of the cup-shaped cylindrical matching element, wherein a first diameter of the top end is aligned with the aperture of the patch antenna, and a second diameter of the top end is aligned with the diameter of the cylindrical middle portion, wherein the diameter of the cylindrical middle portion and a depth of the cylindrical matching element defined by a distance along the first direction between upper and lower ends of the matching element are configured to provide a desired impedance for a second band;

a feed surface coupled with the cylindrical matching element;

a ground plane;

and a pair of generally planar shorting pins coupling the circular patch antenna with the ground plane in a generally perpendicular orientation therebetween.

2. The apparatus set forth in claim 1, wherein the hollow cup-shaped cylindrical matching element is aligned with a center of the circular patch antenna.

3. The apparatus set forth in claim 1 wherein the shorting pins are disposed radially from a surface of the circular patch antenna and outwardly of the matching element.

4. The apparatus set forth in claim 3, wherein the pair of shorting pins are disposed symmetrically about a center of the circular patch antenna.

5. The apparatus set forth in claim 4, wherein the shorting pins are riveted to the ground plane.

6. The apparatus set forth in claim 4, wherein the ground plane has a solder cup aligned with the feed surface.

7. The apparatus set forth in claim 1, wherein:

the patch antenna comprises a continuous annular surface having an outer diameter and an inner diameter that defines the aperture; and the first diameter of the top end matches the inner diameter of the annular surface of the patch antenna.

8. The apparatus set forth in claim 1, wherein the depth of the cylindrical matching element corresponds to operate the circular patch antenna at the second frequency.

9. The apparatus set forth in claim 1, wherein the circular patch antenna, the cylindrical matching element, and the feed surface are formed from a single piece of metal.

10. A method, comprising:

forming a circular patch antenna from a piece of metal, the circular patch antenna defining an aperture in the piece of metal;

forming a hollow cup-shaped cylindrical matching element having a top end, a cylindrical middle portion, and a bottom end, from the piece of metal below the patch antenna in a first direction, the cylindrical middle portion having a diameter, wherein the circular patch antenna is coupled with the top end of the cup-shaped cylindrical matching element, wherein a first diameter of the top end is aligned with the aperture of the patch antenna, and a second diameter of the top end is aligned with the diameter of the cylindrical middle portion, wherein the diameter of the cylindrical middle portion and a depth of the cylindrical matching element defined by a distance along the first direction between upper and lower ends of the matching element are configured to provide a desired impedance for a second band;

forming a ground plane and a first shorting pin between the circular patch antenna and the ground plane;

forming a feed surface at the bottom of the cylindrical matching element; and forming a second shorting pin coupling the circular patch antenna with the ground plane in a generally perpendicular orientation therebetween.

11. The method of claim 10, further comprising bending the piece of metal to form the ground plane and the first shorting pin between the circular patch antenna and the ground plane and forming the shorting pin so as to be disposed radially from a surface of the circular patch antenna and outwardly of the matching element.

12. The method of claim 11, further comprising bending the piece of metal at a second location to form the second shorting pin between the circular patch antenna and the ground plane and forming the second shorting pin so as to be disposed radially from a surface of the circular patch antenna.

13. The method of claim 12, further comprising riveting the first and second shorting pins to the ground plane.

14. The method of claim 12, wherein the first and second pins are disposed symmetrically about a center of the cylindrical patch antenna.

15. The method of claim 11, further comprising forming a solder cup in the ground plane.

16. The method of claim 15, further comprising forming the solder cup underneath the feed surface.

17. The method of claim 11, wherein the depth of the cylindrical matching element corresponds to a selected operating frequency of the second band.

18. The method of claim 11, wherein:

the forming the patch antenna comprises forming a continuous annular surface having an outer diameter and an inner diameter that defines the aperture, wherein the first diameter of the top end matches the inner diameter of the annular surface of the patch antenna.

19. The method of claim 11, wherein the circular patch antenna is formed for operating in a TM02 mode.

20. The method of claim 11, wherein the cylindrical matching element is formed for 50 ohm operation at a predetermined band.

* * * * *